US008668545B2

(12) United States Patent
Schnuckle

(10) Patent No.: US 8,668,545 B2
(45) Date of Patent: Mar. 11, 2014

(54) TOY WITH FLYING EFFECT

(75) Inventor: Gary W. Schnuckle, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 1213 days.

(21) Appl. No.: 12/246,182

(22) Filed: Oct. 6, 2008

(65) Prior Publication Data

US 2009/0093187 A1 Apr. 9, 2009

Related U.S. Application Data

(60) Provisional application No. 60/978,340, filed on Oct. 8, 2007.

(51) Int. Cl.
*A63H 3/20* (2006.01)

(52) U.S. Cl.
USPC ..... 446/330

(58) Field of Classification Search
USPC ..... 446/330, 31, 72, 240–241, 246–248
See application file for complete search history.

(56) References Cited

U.S. PATENT DOCUMENTS

| | | | | | |
|---|---|---|---|---|---|
| 740,293 | A | * | 9/1903 | Loeble | 43/3 |
| 1,083,882 | A | * | 1/1914 | Hindmarsh | 43/3 |
| 2,595,966 | A | * | 5/1952 | Majors | 114/300 |
| 3,435,550 | A | * | 4/1969 | Carlson | 43/3 |
| 5,960,577 | A | | 10/1999 | Walterson | |
| 6,572,428 | B1 | | 6/2003 | Weiser et al. | |
| 6,715,228 | B1 | | 4/2004 | Price | |
| 7,272,906 | B1 | * | 9/2007 | Spaulding, Sr. | 43/3 |
| 2003/0226933 | A1 | | 12/2003 | Richard | |

* cited by examiner

*Primary Examiner* — Alvin Hunter
*Assistant Examiner* — Amir Klayman
(74) *Attorney, Agent, or Firm* — Marsh Fischmann & Breyfogle, LLP; Kent A. Lembke

(57) ABSTRACT

An apparatus for creating a flying effect. The apparatus includes a mounting assembly on a body and a wing assembly attached to the mounting assembly. The wing assembly includes right and left wings and a span member extending between the wings. A drive assembly is provided with a reciprocal drive shaft and a drive for reciprocating the shaft. A contact member extending from an end of the reciprocating shaft contacts the span member to apply a drive force at a drive frequency. The mounting assembly includes a recessed surface, and the span member is positioned over the recessed surface such that the span member is urged toward the recessed surface when the drive force is applied. The span member is formed of flexible material, and the wings move with the spring-like span member as it is urged toward the recessed surface and as it returns to its at-rest position.

14 Claims, 5 Drawing Sheets

TOY WITH FLYING EFFECT

CROSS-REFERENCE TO RELATED APPLICATIONS

This application claims the benefit of U.S. Provisional Application No. 60/978,340 filed Oct. 8, 2007, which is incorporated herein by reference in its entirety.

BACKGROUND OF THE INVENTION

1. Field of the Invention

The present invention relates, in general, to methods and devices for moving wings on a toy or other object to simulate natural flight, and, more particularly, to a toy with components that create a more naturalistic flight effect with the movement of the wings isolated from the toy's body, e.g., such that the body does not appear to shake or vibrate during flight or wing movement.

2. Relevant Background

Children have always had a fascination with flight and flying objects, and winged dolls and other winged toys have always been popular. Flying toys are even more interesting to children when the wings move. For example, winged dolls that appear to fly by fluttering their wings are very attractive toys. Often, the toy does not actually fly but is instead moved by a playing child with the moving wings adding to the flight effect.

Unfortunately, it is difficult to create a toy design that is effective in making the wings move in a manner that creates an illusion of natural flight such as a bird that flaps its wings in a life-like manner. One ongoing problem is how to create a desirable fluttering motion in which the wings move independently of the figurine or toy body. In nature, a flying bird such as a hummingbird moves its wings rapidly to fly while the body appears to remain stationary. In contrast, many flying toys are designed to couple the wing to the body such that when the wings are flapped the entire toy including the body appears to be shaking or vibrating, which is not a natural flight effect. Another design issue is how to suspend the figurine or toy body such that a primary stabilizing force is its own inertia.

Other design issues have limited production and sales of toys that simulate flight. Moving wings at high speed can require a significant amount of power that may require a sizeable motor and power source, and toys may include the motor and power source within the toy body to flap the wings, which results in a relatively heavy and large toy body. Moreover, the fluttering motion itself is difficult to implement with available toy motors. Cost effective and efficient toy motors produce rotational motion but then require additional mechanisms to translate the rotational motion produced by the motor into a fluttering motion that may be useful for driving wing movement.

Hence, there remains a need for toy designs that are effective in simulating natural flight with a realistic wing fluttering or movement. Preferably such toy designs would be relatively simple to manufacture, would be lightweight, and would use inexpensive components.

SUMMARY OF THE INVENTION

The present invention addresses the above problems by providing a toy or other object with a flying effect in which a pair of wings are caused to move or flutter while little or no vibration is experienced by the toy body or winged object. In part, this is achieved by providing a drive assembly or actuation mechanism for the wings that is not onboard or within the body ("offboard actuation"). The flying effect is also achieved by isolating the driving or actuation force from the body such that the body does not vibrate significantly. To this end, some embodiments provide a mounting assembly on the toy body that includes a recessed surface and a pair of wings are attached to the mounting assembly such that a connection bridge or span member extends over the recessed surface. The span member also acts to interconnect the two wings (e.g., the wings and span member may be formed as a unitary piece such as a die-cut piece from a sheet of plastic or the like). The drive assembly may include a reciprocal drive shaft, which may be placed in a protective sleeve or tube, and the drive shaft or a contact member/element extending from its end may apply a drive force at a driving frequency to the span member. In this manner, the drive shaft urges the span member into the recessed surface when it periodically applies the drive force, and the span member's resiliency causes it to spring back out of the recessed surface to its at-rest position. The movement of the span member causes the attached wings to move and, in some cases, the drive frequency is selected to impart a vibration or resonance in the wings that is near their resonant frequencies to provide an enhanced or more natural flight effect.

More particularly, an apparatus is provided for creating a flying effect for a body such as toy or figurine body. The apparatus includes a mounting assembly on or provided as a part of the body. A wing assembly is attached to the mounting assembly, and the wing assembly includes right and left wings and a span member extending between and attached to the right and left wings. The apparatus further includes a drive assembly with a reciprocal drive shaft and a drive operable to cause the drive shaft to reciprocate at a drive frequency. A contact member is provided at an end of the drive shaft distal to the drive. During operation, the contact member contacts the span member to apply a drive force (at the drive frequency) to the wing assembly when the drive shaft is reciprocated by the drive. The mounting assembly may include a recessed surface and the span member is positioned adjacent or over the recessed surface such that the span member is urged toward the recessed surface when the drive force is applied by the contact member of the drive assembly. The span member may include a body of a resilient material that springs back or tends to return to an at-rest position when the drive force is removed, and the span member typically is attached to inner surfaces of the left and right wings to cause the wings to move with the spring-like span member as it is urged toward the recessed surface and as it returns to its at-rest position. For example, the body of the span member may be a substantially planar sheet or rectangle of plastic with a thickness of less than about 0.125 inches (although thicker members may be used in some applications).

In some embodiments, the left and right wings are formed of a flexible material, and the wings have a resonant frequency. The drive force may be selected based on the wing resonant frequency to cause the right and left wings to vibrate or resonate at or near their resonant frequencies. The drive assembly may include a housing configured to contain the drive (e.g., a battery powered or manual motor and devices for translating rotational motion to linear, reciprocating motion) and also include a sleeve or sheath with a lumen through which the drive shaft extends or reciprocates during operation. The sleeve or sheath may be attached at a first end to the housing and at a second end to the mounting assembly. The sleeve may include a magnet near the second end and a magnet may be positioned in the mounting assembly (e.g., spaced apart from the position of the span member of the wing assembly). These two magnets provide a magnetic force coupling when they are placed in proximity to removably attach the sleeve to the apparatus body and also to provide a pivotal coupling (e.g., similar to a universal joint) to allow the body to move relative to the sleeve. The wing assembly may include first and second mounting tabs extending from the inner surfaces or edges of the left and right wings and spaced apart from the span member. To mount the wing assembly to the mounting assembly, the tabs may be affixed or connected to sidewalls or other features of the mounting assembly, and such mounting causes the tabs to define/provide pivot points for the wings relative to the mounting assembly and body that are spaced apart and/or isolated from the span member and the contact member (e.g., to further isolate wing movement from the body).

DETAILED DESCRIPTION OF THE PREFERRED EMBODIMENTS

Briefly, embodiments of the present invention are directed to flying toy assemblies that include a reciprocating (or reciprocal) drive assembly that is connected to a mounting assembly on a toy body. The reciprocating drive assembly may be thought of as an offboard actuation mechanism, and it includes a reciprocal drive shaft that contacts a flexible connection bridge or span member extending between the bodies of a pair of wings, which are also attached to the mounting assembly, to provide a drive force at a particular frequency (drive frequency or reciprocating rate). The drive frequency causes the wings to both flap or flutter, and, in some embodiments, the drive frequency may be chosen to cause the wings to move or flutter/vibrate at or near their resonant frequencies (e.g., the wing bodies may be formed of a thin sheet of plastic or the like that is flexible such that a wave or other pattern is created in response to drive force input when the wing, which may be planar when at rest, is viewed along a side or edge). Embodiments of the present invention provide a wing mechanism that decouples the fluttering motion of the wings from the figurine or toy body itself so that the wings can flutter without appreciable motion and energy being coupled into the figurine itself (e.g., the toy body or figurine appears relatively stable and does not excessively shake or vibrate with wing motions).

Figure 1:
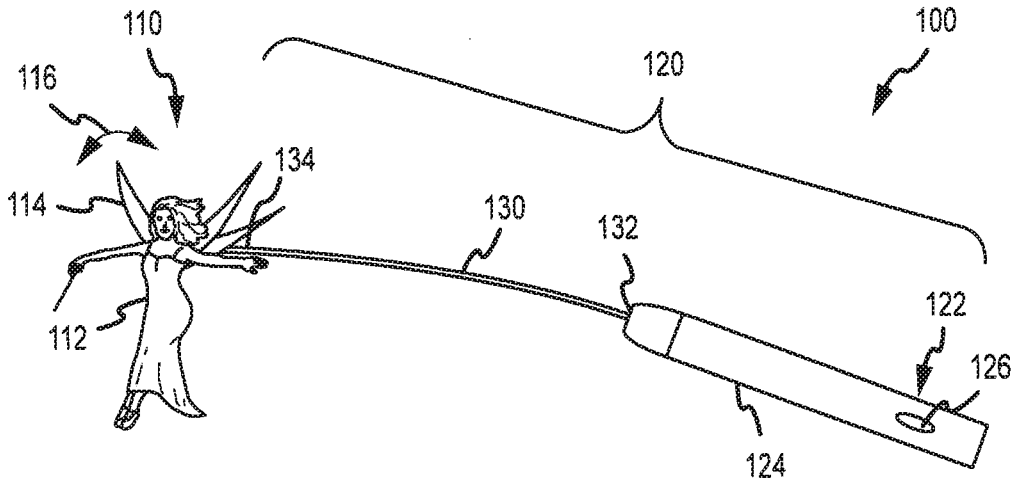
FIG. 1 illustrates a perspective view of a flying toy assembly of an embodiment of the invention showing use of a reciprocating flexible drive shaft to achieve a flying effect.

FIG. 1 illustrates a flying toy assembly 100 of one embodiment of the invention. As shown, the toy assembly 100 includes a figurine with a body 112 upon which a pair of wings or a wing assembly 114 is mounted or attached. In such toys or toy assemblies 100, wings 114 are typically mounted on the back (but may be mounted on other locations of the body), and the figurine 110 with wing assembly 114 is configured or designed to represent a fairy, a bird, an insect, or other creature or object that flies using moving or flapping wings. The wings 114 are typically made of a flexible and resilient material to allow them to be moved in a flapping motion as shown with arrow 116 and also, in some embodiments, to flutter such that wave(s) move along the wing bodies (e.g., the wings 114 are not rigid and do not in these embodiments remain in a fixed configuration such that their "at rest" shape differs at least periodically from the "in flight" shape (s)). For example, the wings 114 may have bodies shaped similar to wings in nature and be formed as a unitary (or from multi-piece or hinged pieces) sheet of plastic or other flexible material such as cut sheet plastic less than about 0.125 inches thick and typically much thinner such as about 0.06 inches down to about 0.03 inches or less (with thickness and material being widely variable to practice the invention and varying with the size and shape of the wings and other design parameters). The body portion 112 of the figurine 110 can be formed of paper, molded plastic, or other available material and decorated with clothes, paint, jewelry, and the like as desired, and the wings 114 may also be decorated to achieve a desired look and/or effect.

The toy assembly or toy set 100 includes the figure 110 with the movable/flexible wings 114, and, significantly, a reciprocating drive assembly or device 120 is included in assembly 100 to provide the driving or motive force to cause the wings 114 to move/flutter 116. Generally, the reciprocating drive assembly 120 includes a drive member or shaft (not shown in FIG. 1) that contacts the wing assembly 114 in an on/off or reciprocating manner at a drive frequency, and the drive assembly 120 is provided as an offboard device that can be selectively attached and removed from the figurine 110 and powered or turned on and off by a user. As shown, the drive assembly 120 includes a drive or drive portion 122 including a housing 124 with an exposed ON/OFF switch 126. A hollow sheath, sleeve, or tube 130 extends from a first end 132 attached to the housing 124 to a second end 134 distal to the housing 124 at which point the drive assembly 120 is detachably connected to the back of the body 112. As is explained below, a reciprocating drive shaft is provided in a lumen of the sleeve 130 with an end or contact surface contacting the wings 114 such that when the drive shaft moves back and forth it alternately applies a driving force at a driving frequency to the wings 114 to impart the fluttering 116.

The drive device housing 124 typically houses a motor and energy source such as a battery as well mechanisms for translating rotational motion of the motor into reciprocating motion (e.g., of a drive shaft in the tube 130 driven by the motor in housing 124). The drive assembly 120 may be configured as a wand as shown in FIG. 1 that is attached to the figurine 110 to enable wing movement 116 in the figurine 110. The wand or shaft 130 may be permanently attached or it may be removably attached (as discussed below) such that the figurine 110 may be played with or used apart from the drive assembly 120 and such that the drive assembly 120 may be used to drive more than one figurine 110 at another or separate time (e.g., same drive assembly 120 may be used to operate 2 or more figurines 110 of the same or differing design). The wand or tube 130 may be relatively long such as 6 to 18 inches or more and may be rigid or flexible (as shown). Also, the tube 130 and included drive shaft are typically relatively small such as less than 0.25 inches in diameter (or outer dimensions when the tube/shaft is not circular in cross section) and even less than about 0.125 inches, with these dimensions varying with the size/weight of the figurine, length of the sheath 130, and other design parameters.

Figure 2:
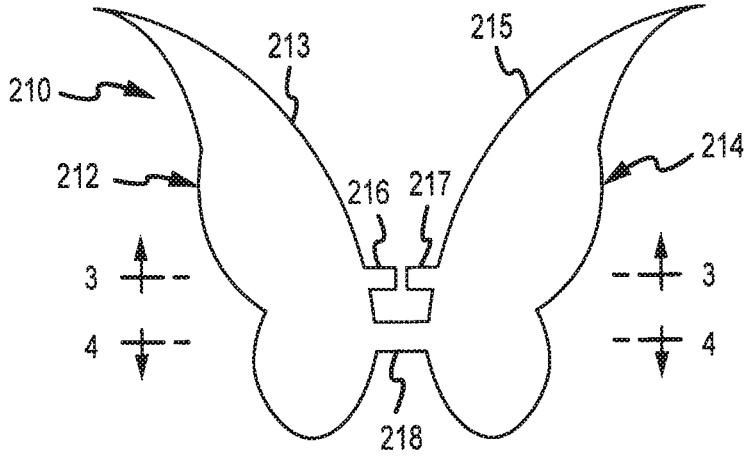
FIG. 2 is plan view of a wing assembly for a flying toy such as the toy of FIG. 1 showing arrangement of a pair of wings joined by a flexible connection bridge or span member.

FIG. 2 illustrates a wing assembly 210 that may be used in figurines such as figurine 110 and provides one exemplary wing shape and implementation. The assembly 210 includes left and right wings (first and second wings) 212, 214 that, as noted above, may be formed of a thin sheet of flexible material such as a few mils to 0.125 inches or more of plastic or other flexible and resilient material with an "at rest" planar configuration (while other embodiments may have a curved or arched at rest shape). In some embodiments, the wing assembly 210 is formed from die-cut or molded plastic. Often the wing assembly 210 will be attached to a relatively small toy or figurine body such as 2 to 5-inch tall body, and in such cases the wing bodies 212, 214 may be about 2 to 5 inches or more in length with a wingspan in a similar or larger range such as 3 to 7 inches. Of course, the concepts described herein may be used with much larger figurine/toy bodies with the driving frequency typically being decreased (slower) for larger wings (e.g., frequency decreased with increased wing body length) to suit the corresponding lower resonant frequency of a larger body 212, 214 and to imitate flight in nature (e.g., smaller winged animals/insects flap their wings more frequently than larger winged animals/insects).

The wing bodies 212, 214 are interconnected (e.g., are one piece) via a flexible connection bridge or span member 218. The span member 218 may be formed of the same material and even same sheet of material as the bodies 212, 214 and extends between inner surfaces 213, 215 such as sides/edges of bodies 212, 214. The span member 218 functions as a contact surface for receiving the driving or actuation force (shown as $F_{drive}$ in FIG. 4) from a drive shaft/member and acts as a living hinge in that it is deformed as the force is applied and then resiliently springs back to its at rest position (or just past this position such as overcorrecting or springing past a planar position). The span member 218 passes the driving force to the bodies 212, 214 to cause them to flap or move when the force is applied and, in some cases, causing the bodies 212, 214 to resonate at their resonant frequencies. The span member 218 may be the same or a different thickness as the bodies 212, 214 and is typically selected to be adequately wide to provide a desired spring force to return the wing to its at rest position when the driving force is removed such as 0.125 to 0.375 or more in width (again the width may depend on a number of factors such as material, material thickness, size/weight of wing bodies 212, 214, and so on). As shown, a pair of mounting tabs 216, 217 extends from the inner surfaces 213, 215 to facilitate attachment of the wings to a figurine (e.g., directly or to an intermediary mounting assembly or the like). Two tabs are shown but one tab may be used in some cases while other embodiments may use 3, 4, or more tabs to attach the wing assembly 210 to a figurine or toy body.

The material used to form the wing bodies 212, 214 and span member 218 has a characteristic spring constant (or constants if member 218 is formed of a different material) that causes the material to return to a defined shape and position (e.g., return to a planar or particular curved shape when at rest or when an external driving force is removed from contact surface of span member 218). During use, as the wings 212, 214 flutter, the interaction between this natural spring and air resistance of the wing result in a resonant frequency that is predictably determined by the size, shape, and particular material choice for the wings 212, 214. It may be useful to control the size and shape of the wings 212, 214 with reasonable precision so that the wings 212, 214 exhibit a resonant frequency near that which will be supplied by the resonant drive wand or reciprocating drive shaft as described below.

Figure 3:
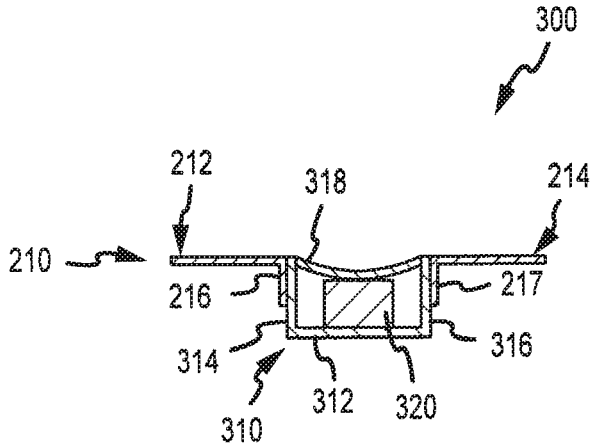
FIG. 3 is a sectional view of the wing assembly of FIG. 2 taken at line 3-3 after attachment of the wing assembly to a mounting assembly (e.g. a box with a recessed lid in this example)

FIG. 3 illustrates a sectional view of winged toy 300 showing the wing assembly 210 after it is attached to a mounting block or assembly 310. As shown in FIG. 2, the wing bodies 212, 214 are formed with mounting tabs 216, 217 extending from inner surfaces 213, 215. To attach the wing assembly 210 to a figurine body, a mounting block or assembly 310 may be provided that is in turn attached to the back or another surface of the figurine body or that is provided as an integral portion of the body (e.g., a block may be formed as a portion of a molded toy body with the features of mounting block 310). As shown, the mounting block 310 includes a bottom 312 and a pair of sidewalls 314, 316 as well as end walls. A top or cover 318 of the box 310 extends between the sidewalls 314, 316 to define a recessed surface relative to the edges of sidewalls 314, 316 and the attached wing bodies 212, 214.

The wing bodies 212, 214 are attached to the mounting assembly 310 in this example by affixing, such as with an adhesive or other methods, the tabs 216, 217 to an interior or exterior (as shown) surface of the sidewalls 314, 316 after bending the tabs 216, 217 (e.g., out of the plane of the wing bodies 212, 214). When the mounting assembly 310 is provide on a figurine body, the wing bodies 212, 214 are attached at two differing points to the figurine body. The attachment point defined by the tabs 216, 217 may be thought of as the pivot or rotation point about which the wing bodies 212, 214 may be caused to flutter or move when a driving force is applied at a spaced-apart location (e.g., at the span member 218). The mounting tabs 216, 217 are also formed of the flexible material of the bodies 212, 214 and so provide pivot points when the tabs 216, 217 are affixed to the mounting block sidewalls 314, 316.

The mounting assembly 310 typically also includes one or more components for allowing the drive tube to be attached to the mounting assembly 310 and, hence, to the figurine body. This attachment may be permanent or at least rigid such as with glue/adhesive, with fasteners, and/or with other mechanical connections such as a ball and socket connection or press fit slots provided on the assembly 310 (or directly on the figurine/toy body) that each mate with a corresponding feature on the drive assembly sheath/tube. In other embodiments, the attachment is adapted to be more easily engaged and removed by a user (e.g., a child playing with a toy). For example, as shown, a magnet 320 is positioned within the mounting box 310 below the arcuate or recessed cover 318, and the tube/sheath is magnetically coupled to the mounting assembly 310 by attractive magnetic forces as a magnet provided in the tube/sheath is brought into proximity of the magnet 320 (e.g., the magnets are arranged with opposite poles facing outward or exposed). The magnet 320 (and magnet in the wand) is chosen to create a detachment force that is greater than the driving force applied by the reciprocating drive shaft so that the figurine remains attached to the drive assembly during operation to simulate flight. The use of magnetic coupling and relatively small magnet 320 allows the coupling to be at a pivot point like a universal joint (rather than a more rigid multipoint or elongate connection) such that the body associated with the mounting assembly 310 can pivot about the connection to the drive shaft sleeve/tube. The use of magnetic coupling also makes it easy for connection to be made and adds to the illusion of a magic wand with no mechanical connection between the drive assembly and the assembly 300.

Figure 4:
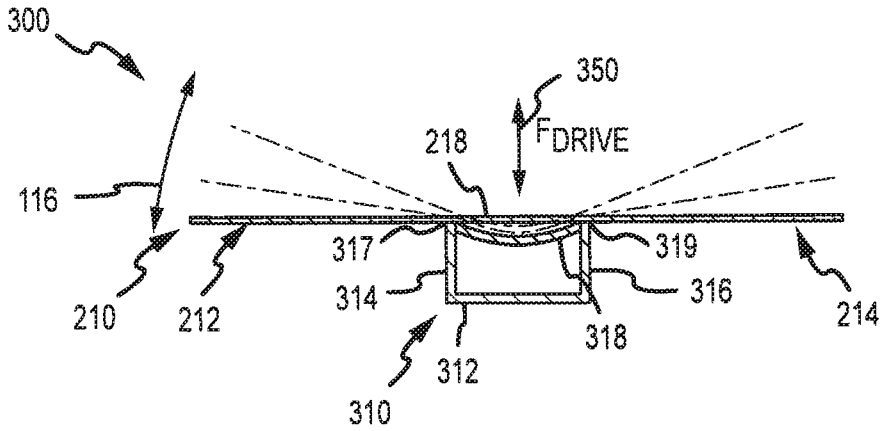
FIG. 4 is a sectional view of the wing assembly of FIG. 2 taken at line 4-4 after attachment of the wing assembly to the mounting assembly and illustrating movement/fluttering (e.g., at or near the resonant frequency of the wing body) of the two wings in response to an input or driving force (that is typically applied in a timed manner or at a drive frequency or input rate) upon the connection bridge or span member.

The wings 212, 214 are attached to each other or interconnected by a bridge or span member 218 that also serves as a drive contact surface for the wing assembly 210. FIG. 4 illustrates a sectional view of the assembly 300 taken through the span member 218. A drive force, $F_{drive}$, shown with arrow 350 is applied to the span member 218 such as at or near the center point between the two sidewalls 314, 316. As shown, the wing assembly 210 is generally planar in its at rest position, and the span member or bridge 218 extends over the recessed surface of the cover/top 318 of the mounting assembly 310. The span member 218 is supported by the top edges 317, 319 of the sidewalls 314, 316. When the driving force, $F_{drive}$, is applied as shown at 350 the wing assembly 210 tends to form a V-shape as the center of the span member 318 is forced toward the recessed surface of cover 318. The depth of the recess defined by cover 318 defines the amount of travel of the span member 218 upon its deformation caused by the drive force, $F_{drive}$, being applied at a particular drive frequency. In some embodiments, the span member 218 is deformed such that it contacts the top or cover 318 while in other cases less deformation is used, and this deformation may, of course, be varied to practice the invention such as several mils to 0.125 inches or more (e.g., larger movement at a slower frequency with increasing wing size or the like to achieve a desired effect). The contact points/edges 317, 319 act as pivot points or living hinge points as the wings 212, 214 begin to move with the application of the driving force, $F_{drive}$. Again, the span distance or distance between sidewall edges 317, 319 may be chosen from a relatively large span but the box 310 typically will be 0.25 to 1 inch or more in width.

The span member 218 is bendable to cause the attached or unitary wings 212, 214 to flutter 116 about the pivot points 317, 319 on walls 314, 316 and connected tabs 216, 217. The span member 218 serves as a spring or resilient member (e.g., a living hinge) that urges the wings 212, 214 back into an at rest position (e.g., a generally planar orientation in the illustrated but not limiting example). In alternative implementations, the spring formed by the wing bridge 218 may be pre-tensioned such that the bridge 218 urges the wings 212, 214 back into a starting or rest position at an arbitrary non-planar orientation. The span or bridge member 218 may be planar with the wings 212, 214 in the at rest position or may be differently shaped such as having an arcuate cross section to achieve a desired wing movement and/or to suit a particular contact element/member of the drive assembly, which is used to apply the drive force, $F_{drive}$, by contacting the span member 218. Again, the wings 212, 214 and span member 218 may be formed from a single or unitary piece of material such as by being cut from a plastic sheet or being molded from plastic or may be formed from multiple pieces of a flexible, resilient material that are attached or connected together by glue, material welds, or other joints.

As shown in FIGS. 2-4, the wings 212, 214 may be affixed to the mounting block 310 by welding, glue, or other technique to connect the tabs 216, 217 to the sidewalls 314, 316. The mounting block 310 may be permanently attached to the body portion of the figurine or integrated with the body portion or it may be removable from the body portion. FIG. 3 shows the mounting tabs 216, 217 bent to form an elbow and then attached in abutting contact to the sides 314, 316 of the mounting block 310. A magnet 320 is formed in, machined in, or mounted/attached to the block 310 such as attached to the bottom 312 of box assembly 310, and the position of the magnet 320 may be about the location of the wing mounting tabs 216, 217 or another location in assembly 310. The magnet 320 is used in practice to attach to a corresponding magnet at the end of a sleeve covering the reciprocating drive shaft and so serves to removably attach the figurine to the sleeve. The sleeve (as shown at 130 in FIG. 1) surrounding or receiving (but generally spaced apart to minimize/limit friction) the reciprocating or reciprocal shaft is stationary relative to the figurine and drive housing, and the magnet 320 is selected to be sufficiently strong to hold the figurine substantially stationary with respect to the sleeve and wand. Alternatively, the sleeve may be affixed to the mounting assembly 310 or figurine body by any available mechanical attachment that is sufficiently flexible and rugged such that the mounting lasts for the lifetime of the toy.

FIG. 4 shows a cross section of the wing/mounting assembly 300 and is taken in the region of the bridge 218 that serves as a spring and as a contact surface for the reciprocating drive shaft (as shown at 350 with the force applied on the outer surface of span member 218 or the inner surface of the span member with the force 350 being a pushing drive force or pulling drive force, respectively). The arrow 350 also suggests the reciprocating motion of the span member 218 that causes fluttering 116 of wings 212, 214 in response to application of the drive force, $F_{drive}$. As the bridge 218 is urged into the channel defined by surface of top 318 or formed in the block 310 (e.g., if this is a solid piece of plastic rather than hollow as shown), it bends and the attached wings 212, 214 pivot 116 out of their resting plane at a rate determined by the speed of the driving force, $F_{drive}$, their weight, air resistance, and properties of the wing material such as resiliency. As the reciprocating force, $F_{drive}$, is removed (e.g., the contact or driving member is often or even typically not attached to the span member 218), the spring action of the wing bridge or span member 218 causes the wings 212, 214 to return to their resting position. Hence, the reciprocating drive assembly needs to only apply force in a single direction (e.g., downward in the example of FIG. 4) and so does not need to be rigidly affixed to the span member 218 (but may be in some applications).

Figure 5:
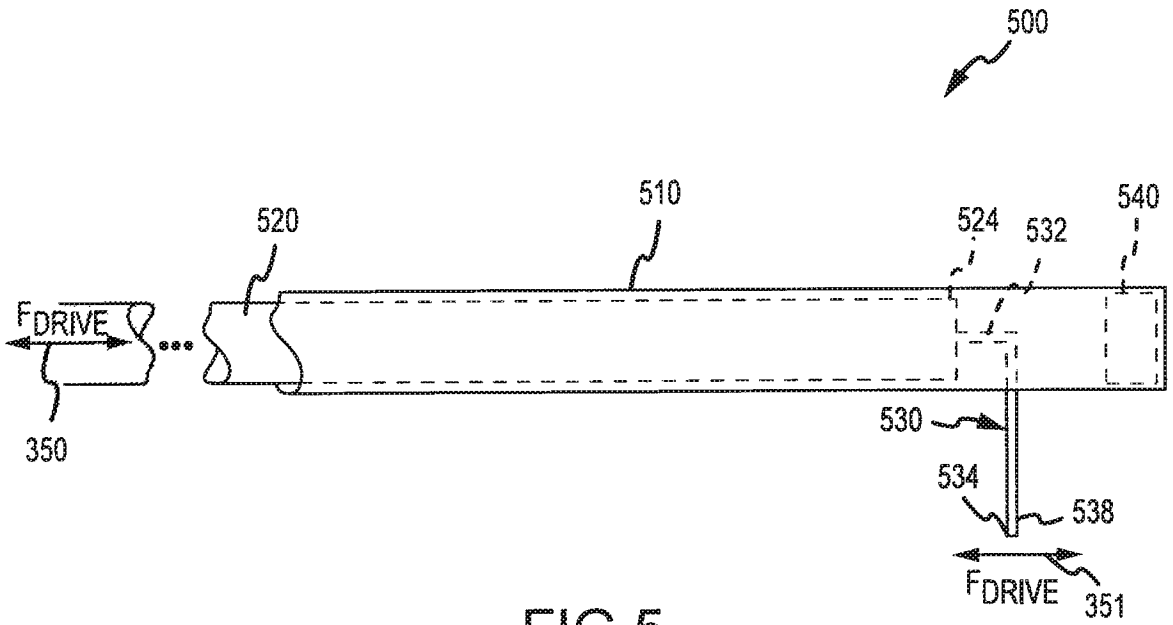
FIG. 5 is a partial view of a reciprocating drive assembly showing a shaft that may move back and forth within a hollow sleeve or tube to cause a contact member or element protruding from the sleeve to move in a reciprocating or pulsing manner (e.g., to drive the wing assembly)

FIG. 5 illustrates a partial view of a reciprocating drive assembly 500 that may be used in a toy assembly (such as in the assemblies/toys shown in FIGS. 1-4 and the like). In the assembly 500, a hollow sleeve (or tube with a lumen) 510 is provided in which a drive shaft 520 is positioned. The shaft 520 is typically connected at a first end (not shown) to a drive and reciprocates as shown at 350 during operation of this drive to apply a drive force, $F_{drive}$, shown at 351 at a drive frequency. In this regard, the sleeve 510 may have an inner diameter that is greater than the outer diameter/dimension of the shaft 520 (e.g., the shaft may be 0.125 inched in diameter while the lumen of the sleeve 510 is 0.13 or the like). Further, a second end 524 of the shaft is spaced apart from the end of the tube or sleeve 510 such that it has room/space to move in a reciprocating motion. A contact or drive element 530 that may be shaped as an "L" may be attached to the end 524 of the shaft 520 at a first end 532 and then extend out from the tube 510 such as via a slot (not shown in FIG. 5) a distance to a second end 534, with the portion extending from the surface of the sleeve 510 defining a wing or span member contact surface 538 of the drive element 530. In operation, for example, the end of the shaft 524 may move from a first or neutral position to a second or drive position with the contact surface 538 contacting the span member for at least a portion of this travel or driving path/distance. For example, the overall travel of surface 538 with end 524 may be 0.25 inches and the contact surface 538 may come into contact with the span member towards the end of this travel to urge the span member to bend and move into the recess of the mounting block/box (e.g., for last 0.125 inches or less of travel). A magnet 540 is positioned within the lumen of the sleeve 510 near its end to mate with a corresponding magnet in the mounting block or box (e.g., magnet 320 in FIG. 3) while in other embodiments mechanical-based coupling mechanisms are provided at the tip or elsewhere on sleeve 510 (e.g., ball and socket arrangement, press fit tabs configured to mate with slots on mounting housing, or the like).

As shown, the reciprocating drive shaft 520 is positioned in a sleeve 510 such that the drive shaft 520 can move back and forth as shown at 350 within the sleeve 510. The arrangement 500 shown in FIG. 5 may be implemented with semi-rigid plastic tubing for sleeve 510 having low friction surfaces inside or facing shaft 520 such as used for model airplane control lines. Reciprocating shaft 520 and sleeve 510 may be semi-rigid but can bend in a continuous curve under the weight of the figurine (such as shown in FIG. 1) or can be intentionally bent (under no additional loading) to provide a desired arc or curved path between the translation mechanism (not shown in FIG. 5) and distal end 524 of the drive shaft 520. A magnet 540 is provided in or on the sleeve 510, and the magnet 540 is used to couple to the magnet in the mounting block/assembly as described hereinbefore. A slot is formed towards the magnet end of the sleeve 510. A rigid "L" formed of plastic, metal, or some other rigid or semi-rigid material is attached to the end 524 of the shaft 520 so as to extend out of the slot. As the drive shaft 520 moves back and forth, the extending portion 538 of the L element 530 moves back and forth (reciprocates) as well. When mounted to a figurine as shown in FIG. 1, the extending portion 538 of the L element 530 contacts the bridge/span member of the wing assembly and drives the two wings or wing bodies to have a motion 116 (e.g., see FIG. 4). Because the reciprocating drive shaft 520 is covered by a sleeve 510, the shaft 520 is not exposed for contact by the user or other objects and the motor will not be stalled when a user holds the sleeve 510.

Figure 6:
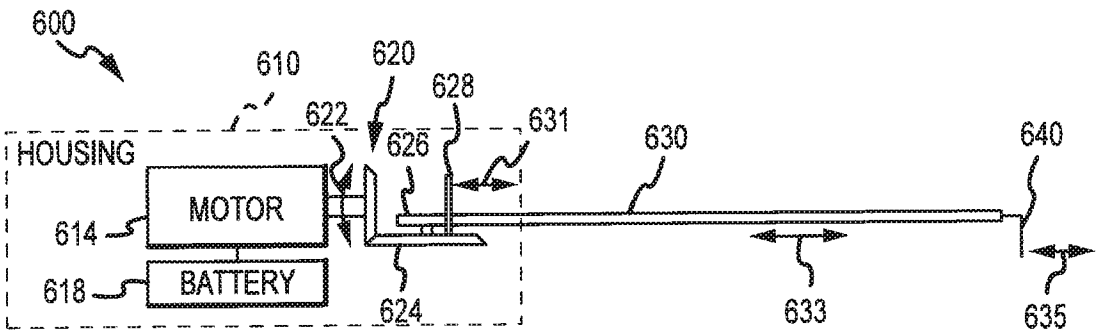
FIG. 6 shows a reciprocating drive assembly with a drive positioned within a housing (e.g., a toy handle, a wand base, a mounted toy's base/stand, or the like)

FIG. 6 illustrates a reciprocating drive assembly 600 as may be used in toy assemblies such as the assembly 100 of FIG. 1. As shown, the drive assembly includes a housing 610 containing or enclosing a motor 614 and a power source or battery 618 for the motor 614. The housing 610 also contains a drive or translation mechanism/assembly 620 that drives (as shown with arrow 631) a reciprocating drive shaft 630 that extends out from the housing to a second end upon which a drive element or force application element 640 is affixed. The battery driven motor 614 produces rotational motion 622 that is speed adjusted using gearing 624 (e.g., one or more speed adjust gears) of translation mechanism 620. A cam or similar device 626 is attached to the final speed adjusted gear or output gear 624 where the cam 626 has one or more eccentricities that cause a mounting or drive plate 628 to move back and forth in a lateral or linear direction as shown with arrow 631. Movement of the plate 628 causes the shaft 630 to have reciprocal movement as shown at arrow 633, which is used to apply a driving force with element 640 as shown with reciprocating force 635. A wide variety of drive mechanisms may be used to implement the reciprocating motion employed by the present invention including reciprocating motors and vibrators that directly produce reciprocating motion rather than rotational motion. The reciprocating shaft 630 is affixed to the mounting plate 628 so that it moves back and forth at a rate (or drive frequency) controlled by the motion of the cam 626.

Figure 7:
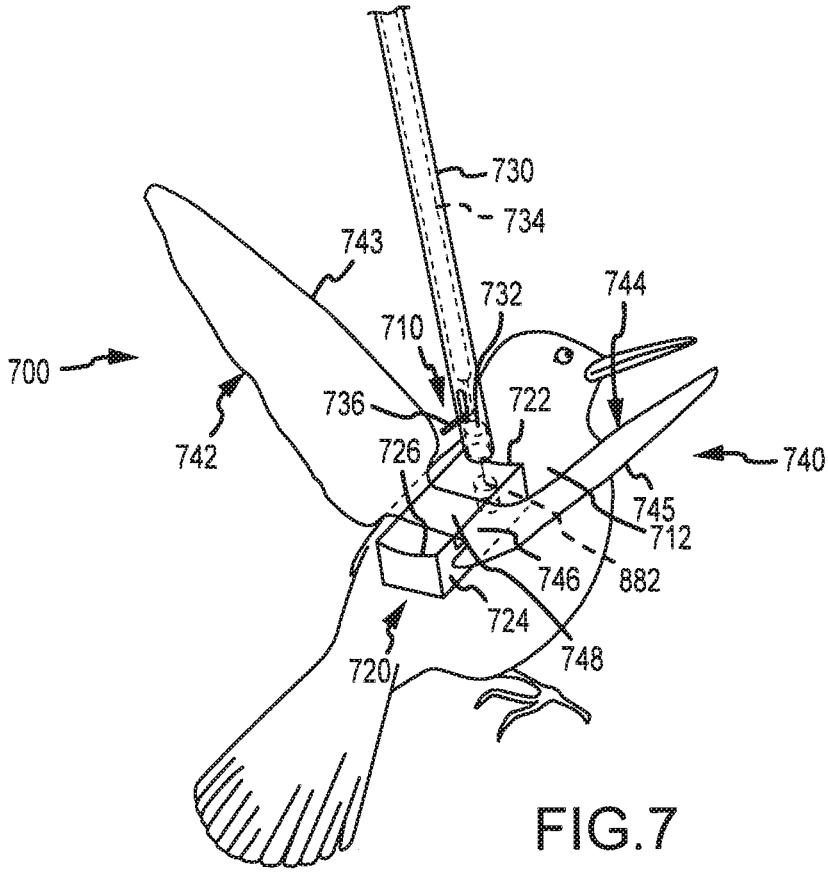
FIGS. 7 and 8 illustrate a rear perspective view and an end view, respectively, of a flying toy assembly showing an exemplary mounting assembly/technique and further illustrating one configuration/arrangement of the wing assembly and the mounting box or assembly.
Figure 8:
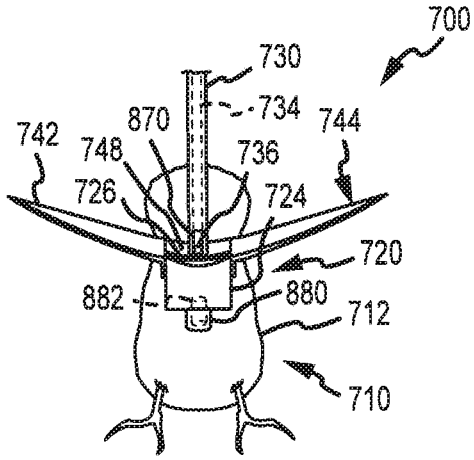

FIGS. 7 and 8 illustrate rear perspective and end views, respectively, of a flying toy assembly 700 of an embodiment of the invention showing an exemplary mounting assembly and/or technique. As shown, the assembly 700 includes a body 710 with a back or upper surface 712. A mounting assembly or box 720 is affixed to the back or upper surface 712 of the body 710, and the mounting assembly 720 includes endwalls 722 and sidewalls 724 as well as recessed surface or arcuate top 726. The mounting assembly 720 may also be considered to include a recessed portion 880 of the back 712 of body 710, and a magnet 882 is positioned within this surface 880 and extends up into the box 720 below or contacting a backside/hidden side of the curved recessed surface of cover/top 726 at one end of the box/block 720.

The toy assembly 700 also includes a wing assembly 740 with a pair of wings 742, 744 that are typically formed of a flexible, resilient material such as a cut shape from a sheet of plastic or the like. The wings 742, 744 include inner surfaces 743, 745 and mounting tabs 746 are provided to attach the wings 742, 744 to the sidewalls 724 of the box or mounting assembly 720 (and, hence, to the body 710) such as adjacent to or proximate to the magnet 882. A span member or bridge connector 748 is provided to interconnect the two wings 742, 744 and this member 748 extends over a portion of the recessed surface defined by mounting assembly cover 726, which defines a space in which the span member 748 may be urged or forced when a driving force is applied to the span member 748.

To this end, the toy assembly 700 includes a drive shaft 734 within a sleeve 730, and the sleeve 730 is connected to the mounting assembly 720 through use of a magnet 732 in (or on) the end of the sleeve 730 that mates with magnet 882. A drive or contact element 736 is attached to the end of the shaft 734 (or may be a bent end/integral portion of the shaft 734) and extends out of a slot or groove 870 in the tube/sleeve 730. As shown, the contact element or drive member 736 contacts the span member 748, and when the shaft 734 is reciprocated at a particular drive frequency, the element 736 applies a drive force to the span member 748 that causes the member 748 to be bent and urged into or toward the recessed surface of cover 726. In turn, this transmits the driving force to the connected wings 742, 744 to cause them to flap. When the drive frequency is properly set for the particular wings 742, 744 (e.g., based on their shape, size, thickness, material, and so on), the body of the wings 742, 744 is caused to move at its resonant frequency, e.g., does not simply flap or move up and down but also a wave moves down the length of the wings 742, 744 such that material away from the contact point of the span member 748 flutters as desired to simulate a natural wing that is not a rigid planar member. A number of drive frequencies may be used to practice the invention but typically there is a range of frequencies where flight simulation is better achieved with resonation along body/length of wings 742, 744 in response to alternating application of a driving force (or on/off contact between the element 736 and span member 748).

The illustrated embodiments generally require a user to use two hands to disengage or release the toy body or figurine from the drive sleeve. In some embodiments, drive assembly may include mechanisms that provide for a one-handed release of the sleeve from the back of the toy body. For example, a lever may be provided on the housing that is connected to one or more release rods may be provided. In use the rods may be spaced apart or contacting the body or a portion of the mounting assembly, and when the release lever is slid or pushed by the user, the release rods may by pushed against the body or mounting assembly to overcome the attachment/coupling force (e.g., apply a detachment force greater than a magnetic coupling force or resistance fit or the like). The disengagement or release rods or components may ride in a lumen in the sleeve or tube or extend on an outer portion of the sleeve.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. In other implementations, the drive wand may be implemented as a glove with the reciprocating drive shaft extending through a finger of the glove, for example. The reciprocating drive shaft may also be implemented in a relatively fixed base rather than with a handheld wand, such as in a desktop ornament or lighting fixture (e.g., the terms "toy," "figurine," "figurine body," and "wings" are used relatively broadly in this description and the following claim sets). These and similar implementations are contemplated and are within the scope of the present invention and following claims.

The above examples show a motorized drive assembly used to move the reciprocating shaft. In other embodiments not shown, the drive assembly may include a manual mechanism to cause the drive shaft to reciprocate to impart a driving force upon the wing assembly. For example, a wind up spring motor may be used to operate a cam or other rotation to linear movement translation mechanism. In other embodiments, a human manipulated trigger or reciprocator may be used to move the drive shaft back and forth at a drive frequency or through a range of drive frequencies. In some embodiments, the battery-powered motor may be a variable speed motor to provide two or more drive frequencies while in still other embodiments the translation mechanism is adjustable to vary the drive or output frequency of the drive assembly.

I claim:

1. An apparatus providing a flying effect for a body, comprising:

a mounting assembly provided on the body;

a wing assembly attached to the mounting assembly comprising a left wing, a right wing spaced apart from the left wing, and a span member extending between the right and left wings; and a drive assembly with a reciprocal drive shaft and a drive operable to cause the drive shaft to reciprocate at a drive frequency, wherein a contact member is provided at an end of the drive shaft distal from the drive, the contact member contacting the span member to apply a drive force at the drive frequency to the wing assembly when the drive shaft is reciprocated by the drive, wherein a body of the span member is deformed by the drive force and, in response to the deforming, the left wing and the right wing pivot on the mounting assembly to provide the flying effect.

2. The apparatus of claim 1, wherein the mounting assembling includes a recessed surface and wherein the span member is positioned adjacent the recessed surface, whereby a portion of the body of the span member is urged a distance toward the recessed surface when the drive force is applied by the contact member.

3. The apparatus of claim 1, wherein the body of the span member is formed of a resilient material springing back to an at-rest position when the drive force is removed and wherein the body of the span member is attached to inner surfaces of the left and right wings.

4. The apparatus of claim 3, wherein the body of the span member comprises a substantially planar sheet of plastic with a thickness of less than about 0.125 inches.

5. The apparatus of claim 1, wherein the right and left wings comprise a flexible material and have a resonant frequency and wherein the drive force is selected based on the resonant frequency to cause the right and left wings to vibrate proximate to the resonant frequency.

6. The apparatus of claim 1, wherein the drive assembly further comprises a housing containing the drive and a sleeve with a lumen through which the drive shaft reciprocates and wherein the sleeve is attached at a first end to the housing and at a second end to the mounting assembly.

7. The apparatus of claim 6, wherein the sleeve includes a magnet proximate to the second end and the mounting assembly includes a magnet spaced apart from the span member and wherein the magnets of the sleeve and mounting assembly provide a magnetic coupling when placed in proximity to provide a pivotal coupling of the sleeve to the mounting assembly.

8. The apparatus of claim 1, wherein the wing assembly further comprises first and second mounting tabs extending from an inner surface of the left wing and the right wing, respectively, and wherein the first and second mounting tabs are spaced apart from the span member and are connected to the mounting assembly, whereby the mounting tabs provide pivot points for the pivoting of the left and right wings on the mounting assembly that are spaced apart from the span member and the contact member of the drive assembly.

9. A winged object comprising:

a body with a mounting assembly with a recessed surface;

a wing assembly with a pair of wings each pivotally attached to the mounting assembly at spaced apart pivot locations and with a span member extending between the wings and placed over the recessed surface; and a drive assembly comprising a drive shaft and a reciprocating drive mechanism for reciprocating the drive shaft at a drive frequency, wherein the reciprocating drive shaft contacts the span member to urge the span member into the recessed surface.

10. The object of claim 9, wherein the span member comprises a body of material with a spring factor causing the span member to return to an at-rest position spaced apart from the recessed surface.

11. The object of claim 9, wherein the body of the span member comprises a planar sheet of plastic and wherein the mounting assembly includes a pair of sidewalls, the body of the span member abutting a top edge of the sidewalls, whereby contact between the body of the span member and the sidewalls define pivot points for a living hinge provided by the span member.

12. The object of claim 9, wherein the pivot locations are spaced apart from the position of the span member.

13. The object of claim 9, wherein the wings comprises substantially planar bodies of flexible material and have a resonant frequency and wherein the drive frequency is selected based on the resonant frequency to cause the wing bodies to vibrate at or near the resonant frequency.

14. The object of claim 9, wherein the drive assembly further comprises a sleeve receiving the drive shaft and adapted for selective coupling with the mounting assembly.

* * * * *